United States Patent [19]

Yodock

[11] Patent Number: 4,946,306

[45] Date of Patent: Aug. 7, 1990

[54] HIGHWAY BARRIER

[76] Inventor: Leo J. Yodock, Box 425, Bloomsburg, Pa. 17815

[21] Appl. No.: 235,675

[22] Filed: Aug. 24, 1988

Related U.S. Application Data

[63] Continuation of Ser. No. 38,641, Apr. 15, 1987, Pat. No. 4,773,629.

[51] Int. Cl.[5] ..... A01K 3/00

[52] U.S. Cl. ..... 404/6; 256/13.1; 256/19

[58] Field of Search ..... 404/6, 9; 256/1, 13.1, 256/19; 188/32

[56] References Cited

U.S. PATENT DOCUMENTS

| | | | |
|---|---|---|---|
| 4,113,400 | 9/1978 | Smith | 404/6 |
| 4,224,002 | 9/1980 | Heenan et al. | 404/9 |
| 4,406,563 | 9/1983 | Urlberger | 404/6 |
| 4,661,010 | 4/1987 | Almer et al. | 404/6 |
| 4,681,302 | 7/1987 | Thompson | 256/13.1 |
| 4,762,438 | 8/1988 | Dewing | 404/6 |
| 4,773,629 | 9/1988 | Yodock | 256/13.1 |

*Primary Examiner*—Jerome W. Massie
*Assistant Examiner*—Matthew Smith
*Attorney, Agent, or Firm*—Lerner, David, Littenberg, Krumholz & Mentlik

[57] ABSTRACT

A highway traffic barrier of the New Jersey style is made from semi-rigid plastic material so that it has some elasticity and will act as a shock absorber, while weighing considerably less than the present day New Jersey style barrier made from concrete. The barrier is hollow and contains interior baffles to provide compartments within the barrier. When in use the barrier is filled with a liquid through filling openings at the top of the barrier and has a weight about equal to the present New Jersey style barriers made of concrete. When the barriers are not filled with a liquid, they weigh considerably less than the present New Jersey style barriers made of concrete. When not in use, the liquid is discharged through discharge openings near the bottom of the barriers. Each barrier has a groove at each end which is adapted to receive a key so that the barriers may be joined together to form a highway barrier of the required length. Handles are provided along with recesses in the sides of the barrier to facilitate moving of the barriers manually. The handles also act as reflectors when they are placed in recesses in the top of the barriers.

24 Claims, 3 Drawing Sheets

HIGHWAY BARRIER

CROSS REFERENCES TO RELATED APPLICATIONS

This application is a continuation of U.S. Pat. application Ser. No. 038,641, filed Apr. 15, 1987, now U.S. Pat. No. 4,773,629.

BACKGROUND OF THE INVENTION

This invention relates to a highway barrier and, in particular, to a highway barrier of the New Jersey style, which is made from semi-rigid plastic material, is hollow, and when in use is filled with a liquid.

Present day highway barriers are used to divide opposing traffic lanes. For the most part, such barriers are made from precast, reinforced concrete. A preferred form of barrier is the New Jersey style barrier, which has a relatively wide base having side walls which extend upwardly from the pavement a short distance, thereafter the walls of the barrier extend upwardly and inwardly for a distance and finally the upper portion of the barrier extends upwardly in a vertical plane. The barrier is designed so that when the wheels of a vehicle contact the barrier, the wheels contact the vertical side walls of the base and the vehicle is forced back into its lane of traffic rather than crossing over into the lane of opposing traffic. U.S. Pat. No. 4,059,362 discloses a highway barrier of the New Jersey style.

One disadvantage of a highway barrier made from concrete is the high weight it possesses. A concrete barrier of the New Jersey style weighs about 3,000 pounds for a barrier having a length of fifteen feet. Thus this large weight necessitates special equipment to handle the barriers. It has been estimated that for some road repairs 40 percent of the dollars expended for the repair are spent on acquiring, delivering and setting up the concrete barriers. Thus, a considerable savings could be realized if a barrier could be made with less weight.

Another disadvantage of a concrete barrier is that concrete has very little ability to absorb shock and reduce damage to vehicles which collide with a concrete barrier.

Still another disadvantage of a concrete barrier is the heavy load to which highways are subjected when the barriers are transported from site to site.

A still further disadvantage of a concrete barrier is the difficulty in placing the barriers due to their high weight.

SUMMARY OF THE INVENTION

It is an object of this invention to provide a highway barrier which is relatively light in weight when the barrier is being transported and moved compared to the present day concrete barriers.

It is another object of this invention to provide a highway barrier which has the ability to absorb shock loads.

It is still another object of this invention to provide a highway barrier which can be transported, stored and handled with relative ease.

It is still another object of this invention to provide a highway barrier which when in place and filled with a liquid weighs about the same as the same style concrete barrier.

In accordance with the present invention, these and other objects have now been accomplished by the invention of a highway barrier structure which includes a longitudinally extending container having a base portion, a pair of side walls, a pair of end walls, and a top portion, and being substantially hollow and comprising a semi-rigid plastic material whereby the container is self-supporting and has a predetermined shape, and filling means for filling said substantially hollow container with a liquid, whereby the filling of the container with the liquid substantially increases the weight of the container without changing the predetermined shape thereof.

In accordance with a preferred embodiment of the highway barrier structure of the present invention, a plurality of longitudinally extending containers are provided, aligned end-to-end, as well as attachment means for attaching first and second longitudinally extending containers to each other so as to provide a continuous highway barrier structure. Preferably, the attachment means comprises groove means extending vertically along a pair of end walls of the first and second longitudinally extending containers, and common key means including a first vertically extending portion adapted to be slidably received in the groove means in the first longitudinally extending container and a second vertically extending portion adapted to be slidably received in the groove means in the second longitudinally extending container, whereby the first and second longitudinally extending containers can be attached to each other by the common key means. Most preferably, the groove means in the first and second longitudinally extending containers include an outer groove width corresponding to the width of the groove at the end portions of the second longitudinally extending containers and an inner groove width corresponding to the width of the groove at the base of the groove, the outer groove width being less than the inner groove width, and in which the first and second vertically extending portions of the common key means include an outer key width substantially corresponding to the inner groove width and an inner key width substantially corresponding to the outer groove width, whereby the common key means can lock together the first and second longitudinally extending containers.

In accordance with a preferred embodiment of the highway barrier structure of the present invention, the groove means includes a groove aperture, and the common key means includes transversely extending passage means which is located at a position corresponding to the groove aperture, whereby the first and second longitudinally extending containers can be fluidly connected therethrough.

In accordance with another embodiment of the highway barrier structure of the present invention, the barrier comprises an elongated, hollow container including a base portion having vertical side walls, an intermediate portion having side walls which slope inwardly and upwardly and a top portion having vertical side walls. The container is preferably made from a semi-rigid plastic material, and includes a plurality of interior baffles positioned within the container to divide the container into a plurality of compartments of about equal volume with passageways near the top of the container to allow liquid to flow from compartment to compartment. The container has means to allow it to be filled with a liquid and means to discharge the liquid from the container. The container also has recesses at the top of the container to receive a handle/reflector. The handle/reflector may also be placed in recesses near the bottom of the container to act as lifting handles when the barriers are to be moved. The barriers preferably have tapered grooves of keyways at each end arranged to receive tapered keys so that adjacent barriers may be locked to each other.

DETAILED DESCRIPTION

Figure 1:
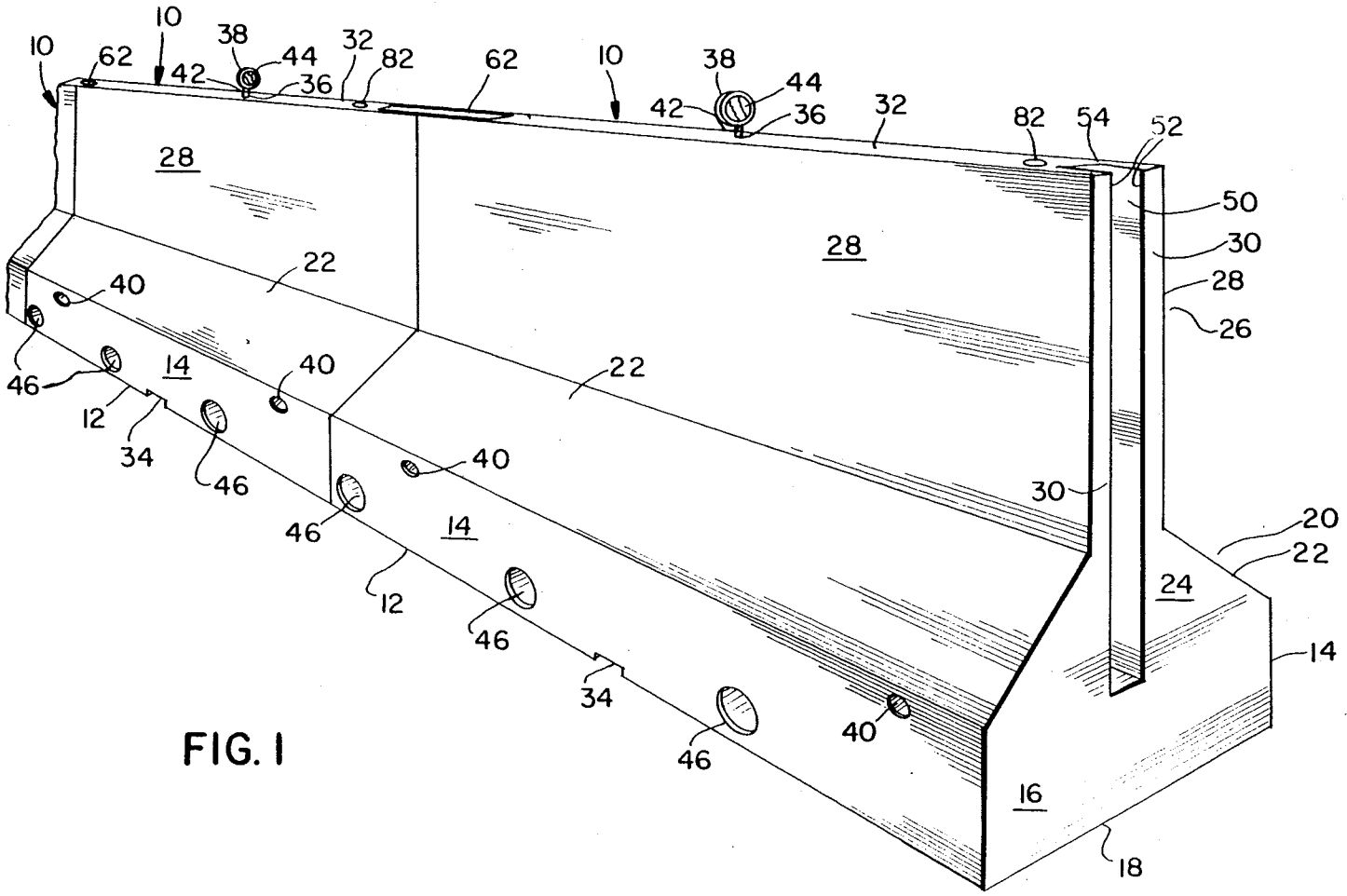
FIG. 1 is a perspective view of the highway barrier of this invention.

In FIG. 1, a number of highway barriers 10 are joined together in a manner hereinafter set forth. Each barrier 10 of this invention comprises an elongated container having a base portion 12 with side walls 14, end wall 16, and a bottom 18. The side walls 14 and end walls 16 rise substantially vertically from and are connected to the bottom 18. An intermediate portion 20 of the barrier 10 has side walls 22 and end walls 24. The side walls 22 of the intermediate portion 20 extend inwardly toward each other and rise upwardly from and are connected to the side walls 14 of the base portion 12. The end walls 24 of the intermediate portion 20 extend vertically and are connected to the end walls 16 of the base portion 12. An upper portion 26 of the barrier 10 has side walls 28, end walls 30 and a top 32. The side walls 28 of the upper portion 26 extend vertically and are connected to the side walls 22 of the intermediate portion 20. The end walls 30 of the upper portion 26 rise vertically and are connected to the end walls 24 of the intermediate portion 20. The top 32 of the upper portion 26 extends substantially horizontally and is connected to the upper ends of the end walls 30 and side walls 28 of the upper portion 26.

Figures 2, 3:
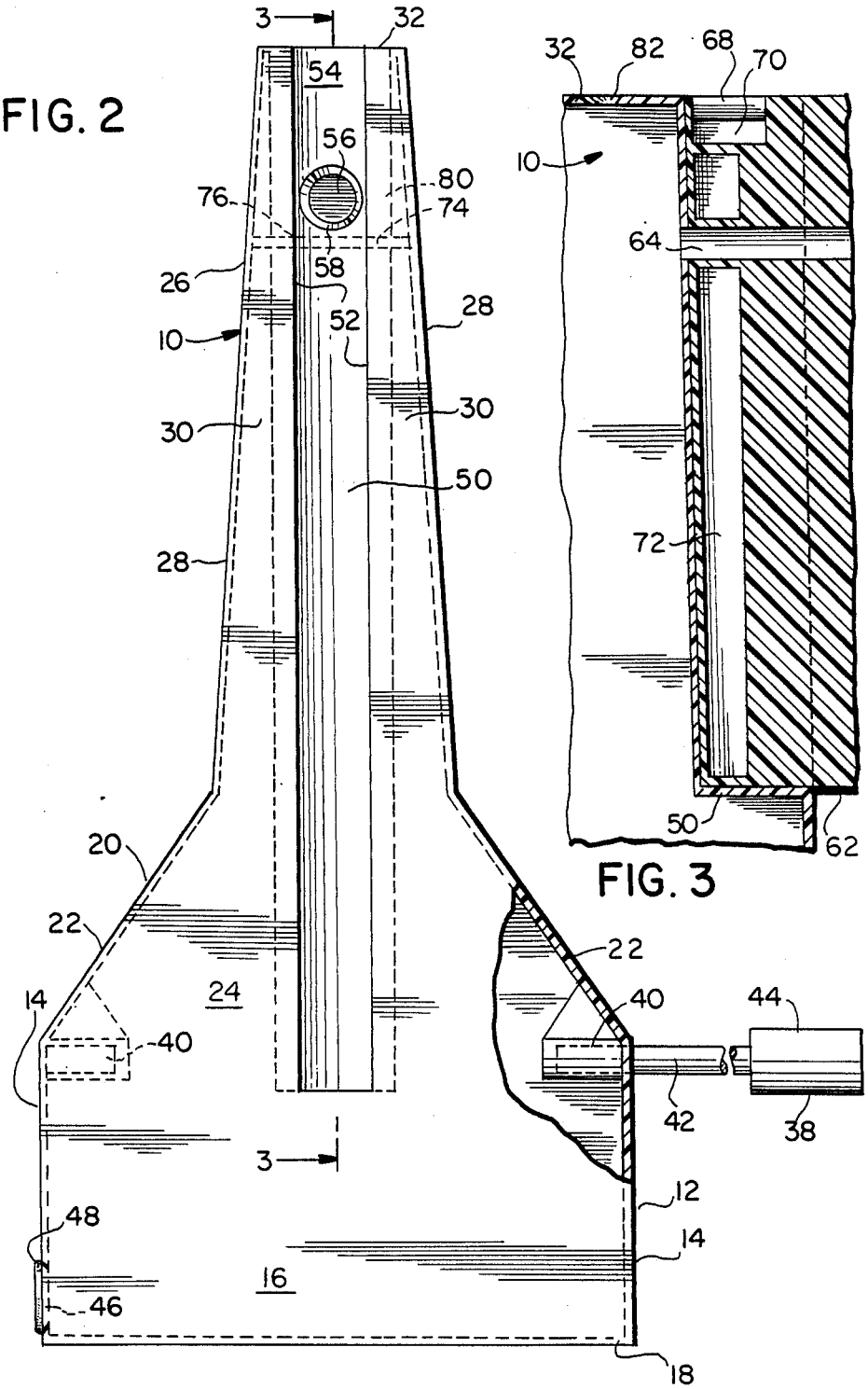
FIG. 2 is an end view of the highway barrier of this invention.
FIG. 3 is a foreshortened view along line 3—3 of FIG. 2 with a key positioned in the groove of the barrier.
Figure 4:
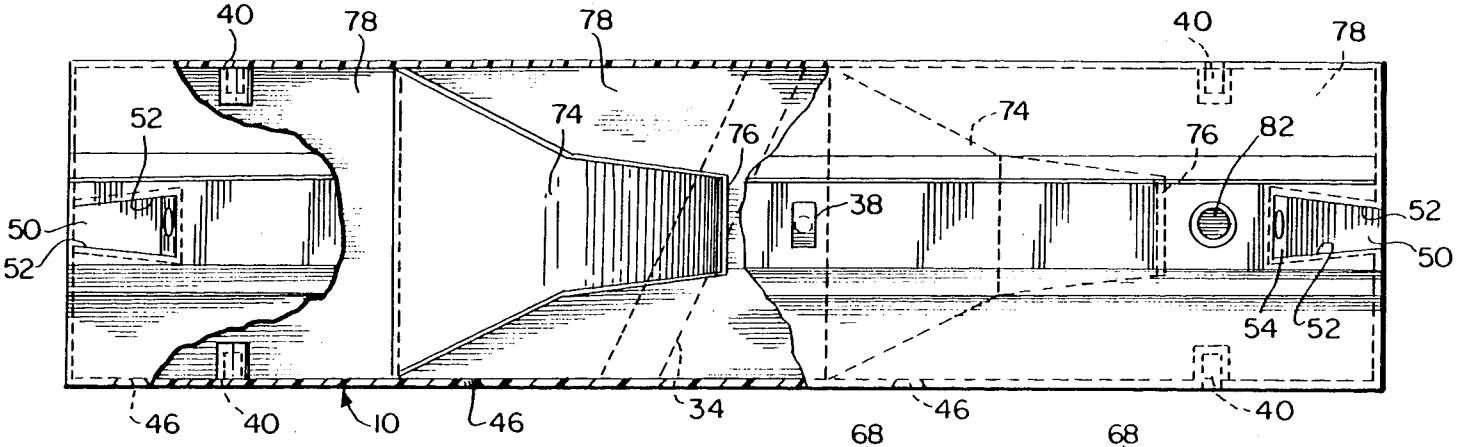
FIG. 4 is a plan view of the highway barrier of this invention with parts broken away to show the interior of the barrier.

The bottom 18 of the barrier 10 includes a transverse recess portion 34 to allow water to run under the barrier 10 from one side of the barrier 10 to the other side, as best seen in FIGS. 1, 2 and 4.

As shown in FIGS. 1 and 4, the top 32 of the barrier 10 includes vertically extending blind hole recesses 36 to receive handle/reflectors 38 which also may be used as carrying handles and reflectors. When used as carrying handles the handle/reflectors 38 are inserted in blind holes or recesses 40 in the side walls 14 of the base portion 12, as shown in FIG. 2, and are used to facilitate lifting and moving the barrier 10. The handle/reflector 38 has a round shaft 42 at one end and a reflector 44 at the other end. When the handle/reflector 38 is in the position shown in FIG. 1 it acts as a reflector to mark the location of a barrier 10 and act as a guide for vehicles.

Referring to FIG. 4, the top 32 of the barrier 10 includes an opening 82 which may be used to supply liquid to the interior of the barrier 10. Suitable means such as a plug or other closure member (not shown) may be used to close the opening 82.

As shown in FIGS. 1 and 4, positioned in the side walls 14 of the base portion 12 are a plurality of discharge openings 46 used to discharge liquid from the barrier 10. As shown in FIG. 2, the discharge openings 46 can be closed by any suitable means such as removable plug 48.

As shown in FIGS. 1 and 2, each barrier 10 has a groove or keyway 50 comprising tapered walls 52 and a base 54 extending from the top 32 of the barrier 10 and terminating short of the bottom 18 of the barrier 10. As best shown in FIG. 4 the groove 50 has an outside width less than the width of the base 54 of the groove 50, that is the walls 52 of the groove 50 taper outwardly and towards each other from the base 54 of the groove 50. Positioned in the base 54 of the groove 50 near the top 32 of the barrier 10 is an opening 56 which extends into the inside of the barrier 10. The outside of the opening 56 is beveled to receive the beveled portion 60 of the key 62 shown in FIG. 5 and provide a liquid-tight seal between the through opening 64 in the key 62 and the opening 56 in the base 54 of groove 50.

Figure 5:
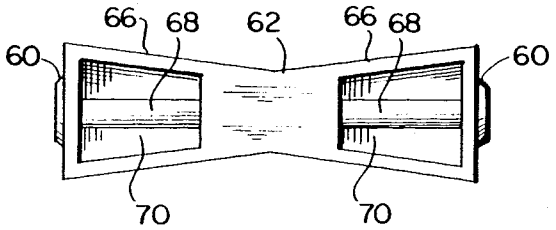
FIG. 5 is a plan view of the key used to connect adjacent barriers together.
Figure 6:
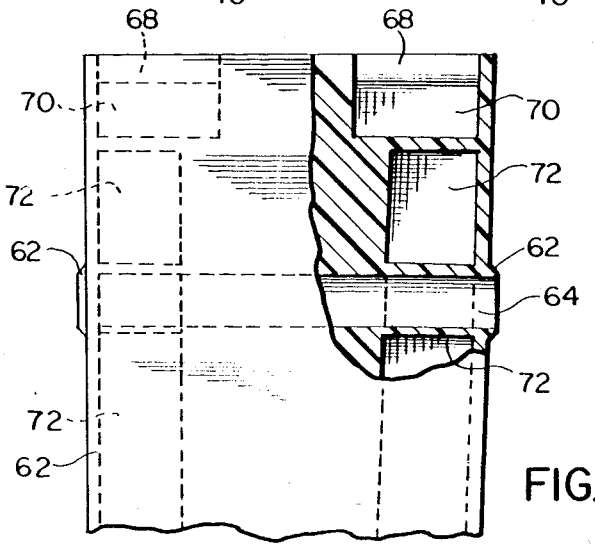
FIG. 6 is a partial elevational view of the key with a broken section.

Referring to FIG. 5, key 62 has tapered side walls 66 adapted to match the tapered side walls 52 of the groove 50 in adjoining barriers 10 and secure adjacent barriers 10 to each other. As best shown in FIG. 6, the key 62 includes handles 68 which are set in recessed areas 70 at the top of the key 62, and a through opening 64. The handles 68 allow the key 62 to be easily inserted and removed from the grooves 50 of the barriers 10. As shown in FIG. 3, the through opening 64 in the key 62 is positioned to fit and to match and be aligned with the opening 56 in the base 54 of the groove 50 and thus allow liquid to pass from one barrier 10 to the adjacent barrier 10, as shown in FIG. 3. In order to reduce its weight, key 62 includes interior hollow portions 72.

Referring to FIG. 4, positioned within the barrier 10 are two interior baffles 74. The baffles 74 extend in a plane transverse to the longitudinal axis of elongated barrier and also transverse to the side walls 14 of the base 12 of the barrier 10 and are connected to the bottom 18, side walls 14, side walls 22 and side walls 28, in a liquid-tight fashion. As best shown in FIG. 2 the top edge 76 of the baffles 74 are spaced from the top 32 of the barriers 10. Thus the baffles 74 form three liquid-tight compartments 78 in the barrier 10, as shown in FIG. 4. The baffles 74 extend upwardly from the bottom 18 of the barrier at an acute angle of about 30 degrees to the bottom of the barrier 10. The compartments 78 formed by the baffles 74 are of substantially equal volume and allow the liquid in the barrier 10 to be evenly distributed throughout the barrier 10, especially should the barrier 10 be placed on a surface which is inclined for up to about nine degrees. The passageways 80 in the barrier 10 which are formed by the top edge 76 of the baffles 74 and the top 32 of the barrier 10 allow liquid to flow from one compartment 78 to the next compartment 78.

The barrier 10 is made of a semi-rigid plastic material selected from the group of materials consisting of low density polyethylene, ABS (acrylonitrile butadene styrene), HIPS (high impact styrene), and polycarbonate. These plastic materials are all inherently tough and semi-rigid and more energy-absorbing than other existing materials. These polYmeric materials will deform and elongate but will not fail in a brittle manner at energy inputs which cause other materials to undergo brittle failure.

In addition, the surface of the above group of materials is inherently smoother than current materials from which barriers are made and people and vehicles contacting the barrier at an angle will be less likely to suffer massive abrasion injuries or damage. The above materials are also unaffected by water and have excellent basic resistance to weathering, leaching or biodegradation. The above materials will also retain their mechanical and chemical properties at low ambient temperatures.

It has been determined that a plastic barrier 10 made from the above materials having a thickness of about one-eighth inch to about one inch will perform satisfactorily in service. A plastic barrier 10 which is 16 feet long and made according to this invention weighs about 400 pounds when it is not filled with a liquid, and about 2565 pounds when it is filled with a liquid, with each compartment 78 holding about 855 pounds.

Under certain circumstances, it may be desirable to provide a plastic barrier 10 with a length of about eight feet so that the barrier 10 may be more easily handled and transported. A barrier 10 having a length of about eight feet would weigh about 200 pounds when empty and about 1283 pounds when filled with water.

When the term "semi-rigid" is used it means that the barrier is made from a material which is capable of allowing the barrier to hold its own shape under normal use; however, the barrier will flex before breaking, as opposed to a "rigid" barrier which also holds its own shape, but will not flex before breaking, and a "non-rigid" barrier which will not hold its own shape.

In practice, the barriers 10 while empty of any liquid are placed on vehicles and transported to the site near where they are to be used. The barriers 10 are then removed from the vehicles with the handle/reflectors 38 placed in recesses 40 in the side walls 14 of the barriers 10 to facilitate handling of the barriers 10. The barriers 10 with the aid of the handles are manually or otherwise then positioned in the location where a highway barrier is desired. Keys 62 are inserted into the grooves 50 of adjacent barriers to secure the barriers 10 to each other. Next, an inspection is made to check to see that all discharge openings 46 are closed by means of plugs 48. Handle/reflectors 38 are removed from the recesses 40 and inserted into recesses 36 in the top 32 of the barriers 10 to act as reflectors. Next a liquid is supplied to one or more filling openings 82 in the top 32 of the barrier 10. As the liquid fills the compartments 78 of a barrier the liquid will pass to the next barrier 10 through openings 56 in the base 54 of the grooves 50 of the barriers 10 and through openings 64 in the keys 62. Obviously to avoid the barriers 10 from becoming airbound, openings 82 in the top 32 of the barriers may be opened. In addition, the last barrier 10 in the line of barriers 10 should have its opening 56 closed by a suitable plug.

The preferred liquid to be supplied to the barriers 10 is water due to its availability and cost. If water is used and there is a possibility that the ambient temperature will drop below the freezing point of water, a suitable anti-freeze compound may be added to the water. Obviously other liquids than water may be used to fill the barriers.

Although I have described my invention hereinabove in considerable detail, I do not wish to be limited narrowly to the exact and specific particulars disclosed, but I may also use such substitutes, modification and equivalents as are included within the scope of my invention or pointed out in the appended claims.

I claim:

1. A highway barrier structure comprising;

a longitudinally extending container having a base portion, a pair of side walls, a pair of end walls, and a top portion, said container being substantially hollow and comprising a semi-rigid plastic material whereby said container is self-supporting and has a predetermined shape;

filling means for filling said substantially hollow container with a liquid, whereby said filling of said container with said liquid substantially increases the weight of said container without changing said predetermined shape thereof and;

each of said pair of end walls defining an aperture adapted to provide fluid communication between said longitudinally extending container and a second longitudinally extending container placed in juxtaposition with said longitudinally extending container.

2. The highway barrier structure of claim 1 wherein said longitudinally extending container comprises a first longitudinally extending container, and including a second longitudinally extending container aligned end-to-end with said first longitudinally extending container, and attachment means for attaching said first and second longitudinally extending containers to each other end-to-end so as to provide a continuous highway barrier structure, said attachment means including passage means at a location corresponding to said aperture in said first and second longitudinally extending containers, whereby said first and second longitudinally extending containers may be fluidly connected therethrough.

3. The highway barrier structure of claim 2 wherein said attachment means further comprises groove means extending vertically along said pair of end walls of said first longitudinally extending container and said second longitudinally extending container, said aperture being disposed within said groove means, and common key means including a first vertically extending portion adapted to be slidably received in said groove means in said first longitudinally extended container and a second vertically extending portion adapted to be slidably received in said groove means in said second longitudinally extending container, said common key means including said passage means, whereby said first and second longitudinally extending containers can be attached to each other by said common key means.

4. The highway barrier structure of claim 3 wherein said groove means in said first and second longitudinally extending containers include an outer groove width corresponding to the width of said groove at said end portions of said first and second longitudinally extending containers and an inner groove width corresponding to the width of said groove at the base, said outer groove width being less than said inner groove width, and wherein said first and second vertically extending portions of said common key means include an outer key width substantially corresponding to said inner groove width and an inner key width substantially corresponding to said outer groove width, whereby said common key means can lock together said first and second longitudinally extending containers thereby.

5. The highway barrier structure of claim 1 including transverse groove means extending across said base portion so as to permit liquid to flow under said base portion of said longitudinally extending container.

6. The highway barrier structure of claim 1 wherein said semi-rigid plastic is selected from the group consisting of low density polyethylene, acrylonitrile butadiene styrene, high impact styrene, and polycarbonate.

7. The highway barrier structure of claim 1 wherein said pair of side walls include a lower portion extending substantially vertically from said base portion for a first predetermined distance, an intermediate portion projecting inwardly from said lower portion a second predetermined distance, and an upper portion extending substantially vertically from said intermediate portion a third predetermined distance to said top portion of said longitudinally extending container. 7

8. The highway barrier structure of claim 7 wherein said semi-rigid plastic material has a thickness of between about one-eighth and one inch.

9. The highway barrier structure of claim 1 including internal baffle means positioned within said longitudinally extending container and extending transversely therewithin between the inner surfaces of said pair of side walls so as to divide said longitudinally extending container into a plurality of container compartments.

10. The highway barrier structure of claim 9 wherein said internal baffle means include top edge portions spaced from said top portion of said longitudinally extending container so as to permit the flow of liquid between said plurality of compartments over said top edge portion of said baffle means.

11. The highway barrier structure of claim 9 including a plurality of said internal baffle means.

12. The highway barrier structure of claim 11 wherein said plurality of said internal baffle means divides said longitudinally extending container into a plurality of compartments having substantially the same volume.

13. The highway barrier structure of claim 1 including discharge means for discharging liquid from said longitudinally extending container.

14. The highway barrier structure of claim 1 wherein said pair of side walls include side recess means, said side recess means being adapted to receive handle members for transporting said longitudinally extending containers therewith.

15. The highway barrier structure of claim 14 wherein said top portion of said longitudinally extending container includes top recess means, said top portion recess means being adapted to receive said handle means.

16. The highway barrier structure of claim 15 including handle means including a shaft portion and a reflector attached to said shaft portion, said shaft portion of said handle means being adapted to be received in both said side recess means and in said top recess means.

17. A highway barrier structure comprising a longitudinally extending container having a base portion, a pair of side walls, a pair of end walls, and a top portion, said container being substantially hollow and comprising a semi-rigid plastic material whereby said container is self supporting and has a predetermined shape; each of said pair of end walls defining an aperture adapted to provide fluid communication between said first longitudinally extending container and a second longitudinally extending container aligned end-to-end with said first longitudinally extending container; filling means for filling said substantially hollow container with a liquid, whereby said filling of said container with said liquid substantially increases the weight of said container without changing said predetermined shape thereof; attachment means for attaching said first and said second longitudinally extending containers to each other end-to-end so as to provide a continuous highway barrier structure, said attachment means including passage means at a location corresponding to said aperture and said first and second longitudinally extending containers, whereby said first and second longitudinally extending containers may be fluidly connected therethrough, groove means extending vertically along said pair of said end walls of said first longitudinally extending container and said second longitudinally extending container, said aperture being disposed within said groove means, and common key means including a first vertically extending portion adapted to be slidably received in said groove means in said first longitudinally extending container and a second vertically extending portion adapted to be slidably received in said groove means in said second longitudinally extending container, said common key means including said passage means whereby said first and second longitudinally extending containers can be attached to each other by said common key means, and wherein said groove means of said first and second longitudinally extending containers include an outer groove width corresponding to a width of said groove at said end portion of said first and second longitudinally extending containers and an inner groove width corresponding to the width of said groove at the base of said groove, said outer groove width being less than said inner groove width and wherein said first and second vertically extending portions of said common key means include an outer key width substantially corresponding to said inner groove width and an inner key width substantially corresponding to said outer groove width, whereby said common key means can lock together said first and second longitudinally extending containers thereby.

18. A highway carrier structure comprising a longitudinally extending container having a base portion, a pair of side walls, a pair of end walls, and a top portion, said container being substantially hollow and comprising a semi-rigid plastic material whereby said container is self-supporting and has a predetermined shape; filling means for filling said substantially hollow container with a liquid, whereby such filling of said container with said liquid substantially increases the weight of said container without changing said predetermined shape thereof; and internal baffle means positioned within said longitudinally extending container and extending traversely therewithin between the inner surfaces of said pair of sidewalls so as to divide said longitudinally extending container into a plurality of container compartments.

19. The highway barrier structure of claim 18 wherein said internal baffle means include top edge portions spaced from said top portion of said longitudinally extending container so as to permit the flow of liquid between said plurality of compartments over said top edge portion of said baffle means.

20. The highway barrier structure of claim 18 including a plurality of said internal baffle means.

21. The highway barrier structure of claim 20 wherein said plurality of said internal baffle means divides said longitudinally extending container into a plurality of compartments having substantially the same volume.

22. A highway barrier structure comprising a longitudinally extending container having a base portion, a pair of side walls including side recess means, said side recess means being adapted to receive handle members for transporting said longitudinally extending containers therewith, a pair of end walls, and a top portion, said container being substantially hollow and comprising a semi rigid plastic material whereby said container is self-supporting and has a predetermined shape; and filling means for filling said substantially hollow container with a liquid, whereby said filling of said container with said liquid substantially increases the weight of said container without changing said predetermined shape thereof.

23. The highway barrier structure of claim 22 wherein said top portion of said longitudinally extended container includes top recess means, said top portion recess means being adapted to receive said handle means.

24. The highway barrier structure of claim 23 including handle means including a shaft portion and a reflector attached to said shaft portion, said shaft portion and said handle means being adapted to be received in both said side recess means and in said top recess means.

* * * * *